United States Patent [19]

Gadd

[11] Patent Number: 4,630,830

[45] Date of Patent: Dec. 23, 1986

[54] BINGO GAME CARD HOLDER

[76] Inventor: Helen E. Gadd, 2200 North 73rd Ave., Elmwood Park, Ill. 60635

[21] Appl. No.: 302,828

[22] Filed: Sep. 16, 1981

[51] Int. Cl.[4] ..... A63F 3/06

[52] U.S. Cl. ..... 273/240; 273/269

[58] Field of Search ..... 273/240, 269, 270, 148 R, 273/148 A, 281; 129/20; 40/158 B, 159, 373, 374

[56] References Cited

U.S. PATENT DOCUMENTS

| | | | |
|---|---|---|---|
| 2,497,341 | 2/1950 | Bisson | 273/269 X |
| 3,811,680 | 5/1974 | Benesch | 273/240 X |
| 3,869,820 | 3/1975 | Holson | 40/159 |
| 3,921,322 | 11/1975 | Sharp | 40/159 X |
| 4,133,536 | 1/1979 | Cole | 273/240 |
| 4,165,878 | 8/1979 | Frain | 273/240 |
| 4,202,122 | 5/1980 | Namiki | 40/158 B |
| 4,259,799 | 4/1981 | Fulton | 40/159 |

*Primary Examiner*—Harland S. Skogquist

*Attorney, Agent, or Firm*—Wood, Dalton, Phillips, Mason & Rowe

[57] ABSTRACT

A bingo game card holder having a base defining a plurality of pockets for holding one each bingo game cards in laterally related disposition. A light-transmissive cover is retained releasably in overlying relationship to the pockets for releasably retaining the selected bingo game cards therein. The exposed upper surface of the cover is constructed to be readily marked by conventional erasable marking elements to identify the called numbers appearing on the cards retained in the pockets. The cover, in the illustrated embodiment, is releasably retained by retaining structure at opposite portions thereof. In the illustrated embodiment, the periphery of the cover is spaced inwardly of the periphery of the base and structure is provided for defining access to an edge portion of the cover for facilitated installation and removal. The base, in the illustrated embodiment, defines an integral handle for use in carrying the assembled card holder.

12 Claims, 7 Drawing Figures

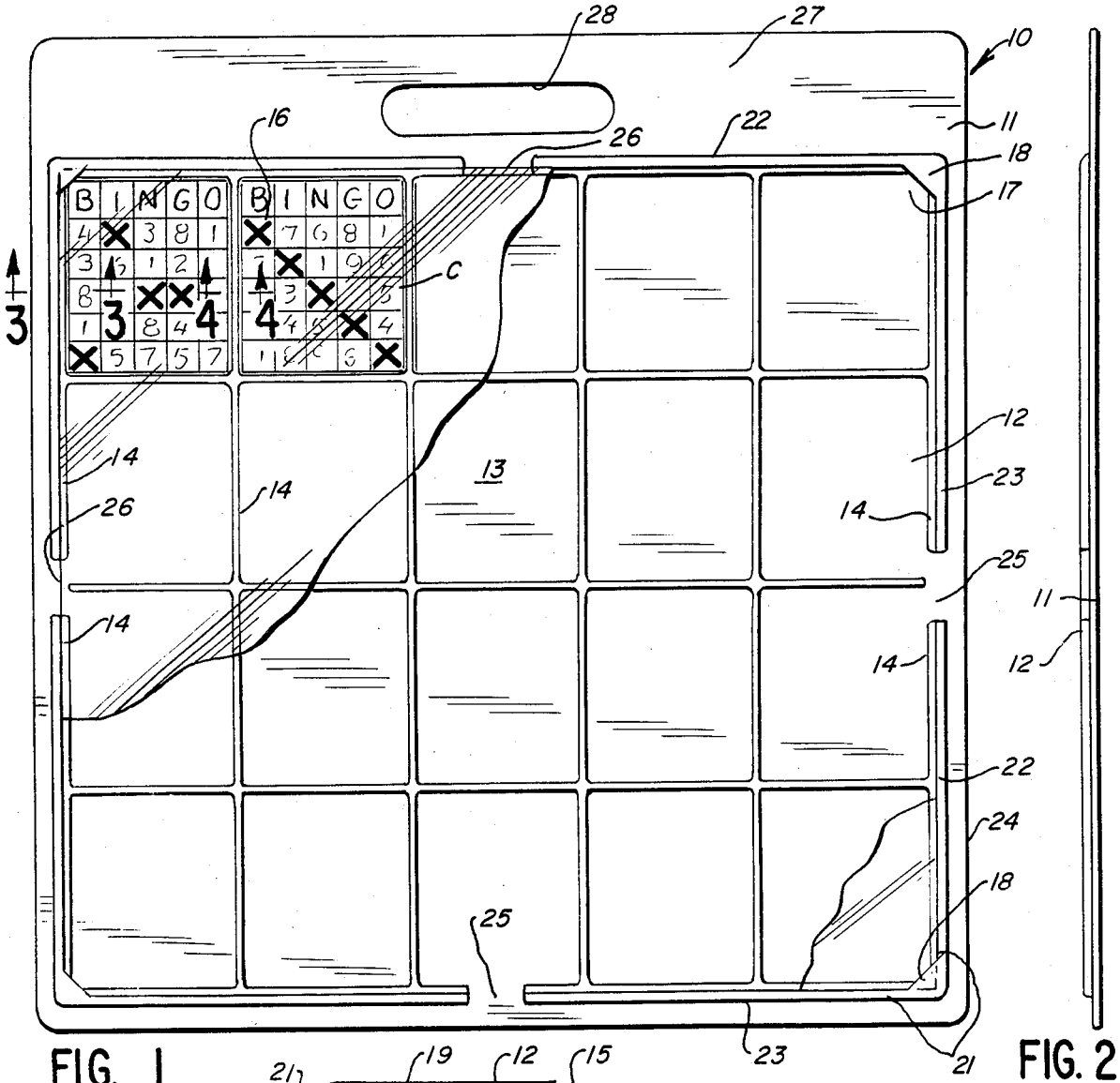
FIG. 1
FIG. 2
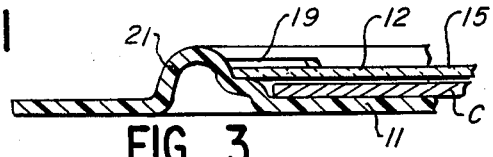
FIG. 3
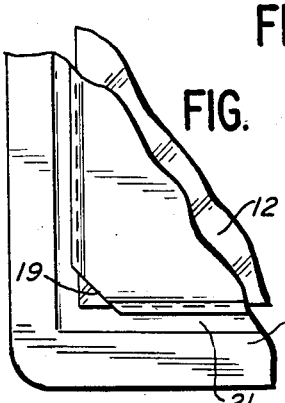
FIG. 5
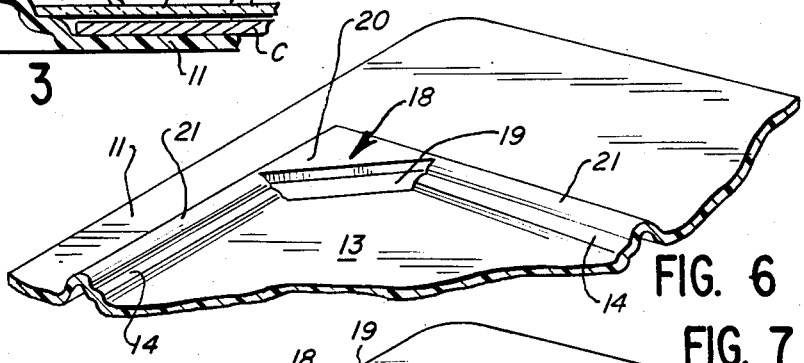
FIG. 6
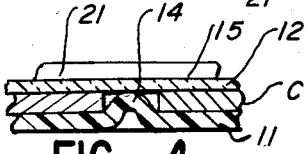
FIG. 4
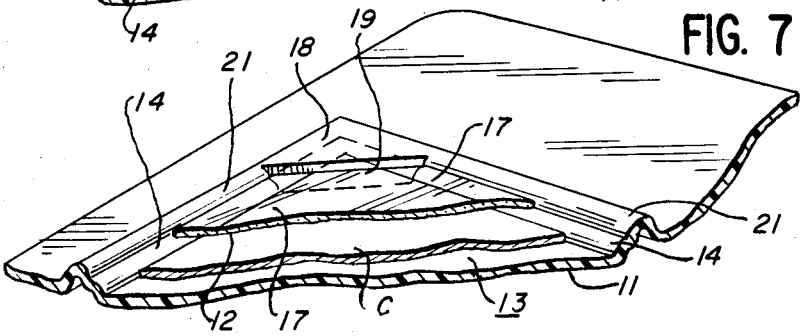
FIG. 7

BINGO GAME CARD HOLDER

BACKGROUND OF THE INVENTION

1. Field of the Invention

This invention relates to bingo game devices and in particular to a bingo game card holder.

2. Description of the Background Art

In the play of the well-known bingo game, the player places markers on different numbers appearing on a bingo card. Conventionally, the player may be playing a number of such cards concurrently. The cards must be suitably supported so that the player can scrutinize all of the cards as each number is called in the play of the game. Upon conclusion of a game, all of the markers must be removed from the cards so that the cards may be re-marked when used in a subsequent game.

At times, the player may be concurrently playing a substantial number of cards, such as 20 or more cards. It has been found difficult to maintain a relatively large number of cards aligned in front of the player. Further, the markers may fall or be moved as by jostling and constitute a vexatious problem in the play of a substantial number of cards concurrently.

One attempted solution to the problem of maintaining the cards in side-by-side lateral disposition is illustrated in U.S. Pat. No. 2,497,341 of Leo J. Bisson. As shown therein, each of the cards is provided with interlocking means on its peripheral edges so as to interlock with the laterally adjacent cards, permitting a number of the cards to be locked together.

Another arrangement for supporting bingo cards on the lap of a player is illustrated in U.S. Pat. No. 3,811,680 of Frederick E. Benesch. As shown therein, the support for the cards comprises a plurality of boards interlinked to accommodate a number of bingo cards concurrently used by the player. Removable legs are attachable to the boards so as to permit the boards to be supported on the lap of the player at an inclined angle or on a table surface in front of the player. Benesch suggests the use of a clear overlay sheet having edges overlapping the edges of the table and provided with a downturned flange for preventing lateral displacement of the sheet on the table. Benesch further suggests that one edge of the overlay sheet may be secured to the table.

Another device for holding a plurality of bingo cards is illustrated in U.S. Pat. No. 4,165,878 of John J. Frain. Frain discloses the use of a markable panel which is inserted in a pocket to overlie the bingo number field, with an overlying cover panel of the pocket provided with openings through which the transparent sheet may be marked. Frain teaches that the transparent insert sheet may be shifted to expose an unmarked portion in playing a second game and teaches that at least four plays may be carried out by so repositioning the transparent insert sheet.

Charles Cole discloses, in U.S. Pat. No. 4,133,536, another form of bingo card holding and marking device wherein a transparent plastic sheet is provided with a plurality of groups of circular holes. The sheet has an adhesive coating on one surface to permit it to be releasably mounted on a plurality of bingo cards, in turn releasably secured to an adhesive coating on a backing plate to permit working of the numbers of each of the bingo cards so that a bingo player may play a plurality of cards simultaneously. The cards may be marked through the openings in a manner similar to the marking through the openings in the frame structure.

The concept of marking a transparent overlay sheet in the play of a game utilizing a card having different indicia thereon is illustrated in U.S. Pat. No. 3,603,592 of Joe Bury. As shown therein, the game apparatus consists of rectangular background cards having transparent front panels secured to the background card at three edges, leaving an open edge. Auxiliary cards are inserted between the transparent front panel and the background card, and a crayon is provided for marking a box of the auxiliary cards. The crayon markings on the transparent panel are erasable to permit reuse of the assembly.

SUMMARY OF THE INVENTION

The present invention comprehends an improved bingo game card holder having a base having a plurality of upwardly opening pockets adapted to receive one each a plurality of bingo game cards in laterally related disposition for viewing of the plurality of cards by a player, light-transmissive cover means for covering the bingo game cards received in the pockets while permitting reading of the cards therethrough, the cover means defining an upper writing surface constructed to be marked by conventional erasable marking means to identify called numbers appearing on the cards in the pockets, and means at opposite portions of the cover means for releasably retaining the cover means on the base in overlying relationship to the pockets for retaining the cards therein.

In the illustrated embodiment, the base is formed of a light-transmissive synthetic resin.

In the illustrated embodiment, the base is provided with a handle for use in carrying the assembled card holder. The handle may comprise an integral portion of the base.

In the illustrated embodiment, the cover sheet is retained to the base by corner portions received in retaining means on the base. Illustratively, the retaining means may comprise openings in the base removably receiving the corner portions of the cover.

The base may be provided with upstanding shoulder means for retaining the edges of the cover against displacement. The shoulder means may define a gap providing access to the edge of the cover for facilitated installation and removal.

The base and cover may be formed of synthetic resin. Thus, the improved bingo game card holder of the present invention is extremely simple and economical of construction while yet providing an improved reusable card holder effectively positively retaining the individual cards being played at a given time, permitting ready re-marking of the cards in playing subsequent games, and permitting facilitated portable use.

BRIEF DESCRIPTION OF THE DRAWING

Other features and advantages of the invention will be apparent from the following description taken in connection with the accompanying drawing wherein:

FIG. 1 is a plan view of a bingo game card holder embodying the invention, with portions broken away to facilitate illustration of the structure thereof, and illustrating a number of bingo cards installed in the pockets of the base portion thereof;

FIG. 2 is a side elevation of the card holder;

FIG. 3 is a fragmentary enlarged vertical section taken substantially along the line 3—3 of FIG. 1;

FIG. 4 is a fragmentary enlarged vertical section taken substantially along the line 4—4 of FIG. 1;

FIG. 5 is a fragmentary rear plan view illustrating the means for releasably retaining the cover sheet in association with the base;

FIG. 6 is a fragmentary perspective view of the retaining means of the base; and FIG. 7 is a view similar to that of FIG. 6 but illustrating the assembly of the cover and base sheets with a bingo card received in a pocket of the base.

DESCRIPTION OF THE PREFERRED EMBODIMENT

In the illustrative embodiment of the invention as disclosed in the drawing, a bingo card holder generally designated 10 is shown to comprise a base 11 and a cover 12.

The base defines a plurality of pockets 13 each adapted to receive a bingo game card, such as card C illustrated in FIG. 1. In the illustrated embodiment, 20 such pockets are provided in the base whereby 20 different bingo cards may be retained in the pockets to be disposed in laterally related side-by-side juxtaposition for concurrent viewing by the game player.

In the illustrated embodiment, the base is formed of a synthetic resin having integrally formed therein a plurality of upstanding walls 14 defining the respective pockets 13. The walls project upwardly from the flat base a distance substantially equal to the thickness of the cards to be retained therein so that the cover sheet facially engages the top surface of the cards. The cover is formed of a suitable light-transmissive synthetic resin permitting reading of the indicia on the cards retained in the pockets.

The upper surface 15 of the cover sheet, in the illustrated embodiment, comprises a matte surface for facilitated marking thereof by conventional erasable marking means, such as crayons, chalk, water-soluble markers, etc. Thus, as illustrated in FIG. 1, the cover may be marked with X's 16 to identify numbers which have been called during the play of the game.

In the illustrated embodiment, the base is formed of a synthetic resin which may have a smooth finish. An excellent example of synthetic resin suitable for such use as the base and cover structures comprises Plex-G acrylic resin having a thickness of approximately 1/16".

The invention further comprehends a novel means for retaining the cover sheet in overlying relationship to the pockets so as to effectively releasably retain the cards C in the pockets for facilitated marking of the cover sheet during the play of the game as discussed above. More specifically, as illustrated in the drawing, the cover sheet defines corner portions 17 adapted to be removably received in complementary retaining portions 18 on base 11. As shown, the retaining portions 18 comprise offset portions of the base defining openings 19 facing toward the field of pockets 13.

As shown in FIG. 6, opening 19 effectively comprises a slot opening to the corner pocket and includes an upper triangular wall 20. Upstanding ribs 21 are formed in the base 11 and extend about the retaining portion 18 to define legs 22 and 23 spaced inwardly of the periphery 24 of base 11. As best seen in FIG. 1, the legs are spaced apart midway along each edge of the base so as to define gaps 25 providing access by the user of the device to the edge portions 26 of the cover sheet between the opposed ends of the legs 22 for facilitated handling of the cover sheet in installation and removal relative to the base.

As further illustrated in FIG. 6, the pocket defining walls 14 are formed integrally with the ribs 21 at the edges of the pockets juxtaposed to the ribs 21. As illustrated in FIG. 1, the walls 14 terminate in spaced relationship to each other at gaps 25 to permit the desired access to the cover sheet edge at the gaps.

As seen in FIG. 7, the bingo card C is retained in the pocket 13 by the overlying cover sheet 12. The cover sheet rests on the pocket defining walls 14 inwardly of the ribs 21 and with the corner portion 17 of the cover sheet extending into the slot 19 so as to be retained by the retaining portion 18 of the base.

As shown in FIG. 4, walls 14 have a height similar to the thickness of the bingo card C so that the cover sheet effectively rests on the bingo cards so as to provide desirable support thereof when marking the upper surface 15 of the cover sheet with the indicia 16, as illustrated in FIG. 1.

Ribs 21 further serve to prevent spilled liquids and the like from flowing into the pockets along a major portion of the periphery of the base 11.

As further illustrated in FIG. 1, base 11 defines an edge portion 27 provided with an opening 28 defining a handle for carrying the card holder assembly. As indicated above, the base and cover sheets are formed of relatively lightweight synthetic resin and, thus, the card holder is readily transportable by the player to and from the bingo playing site.

In use, the player places the bingo cards to be played in the respective pocket 13 of the base, with the cover sheet removed. The card holder permits the concurrent playing of any number of such bingo cards concurrently from a single card in one of the pockets to a full set of 20 cards in the 20 pockets provided. As will be obvious to those skilled in the art, the card holder may be arranged to provide any suitable number of pockets, the arrangement providing 20 pockets being exemplary only.

The cover sheet is then installed over the pockets and cards therein by inserting the four corners of the cover sheet into the retaining portions 18 of the base through the slots 19 thereof. As best seen in FIG. 1, when so installed, the cover sheet is nested within the peripheral ribs 21 of the base and is prevented further from lateral translation by the ribs as well as the retention action of the corner retaining means 18.

The cover sheet effectively retains each of the cards in the pocket in which it was placed so as to maintain the cards in laterally juxtaposed side-by-side relationship for facilitated playing of a number of the cards concurrently by the player.

As discussed above, the identification of the numbers called during the playing of the game may be effected by suitably marking the upper surface of the cover sheet by suitable erasable means, such as crayons, etc. The markings, such as the X's 16 illustrated in FIG. 1, may be readily removed upon completion of a game by wiping thereof from the surface 15, permitting a subsequent game to be played with an unmarked cover sheet without the need for removing the cover sheet from the assembly.

To remove the bingo cards, the user simply inserts his fingers through any one of the peripheral gaps 25 to engage the exposed edge 26 of the cover sheet, permitting it to be suitably flexed for removing the corner portions 17 from the retaining means 18.

In the illustrated embodiment, the base 11 is formed of a light-transmitting material. The base portion 27 is adapted for placement thereon of the player's name or other indicia as desired.

The card holder may be utilized with other game cards as desired, the illustration of the card holder with respect to the bingo cards being exemplary of one use thereof.

The foregoing disclosure of specific embodiments is illustrative of the broad inventive concepts comprehended by the invention.

I claim:

1. A bingo game card holder comprising:

means defining a base having a plurality of upwardly opening pockets adapted to receive one each a plurality of bingo game cards in laterally related disposition for viewing of the plurality of cards by a player;

light-transmissive cover means for covering the bingo game cards received in said pockets while permitting reading of the cards therethrough, said cover means defining an upper writing surface constructed to be marked by conventional erasable marking means to identify called numbers appearing on the cards in said pockets; and means at opposite portions of said cover means for releasably retaining said cover means on said base in overlying relationship to said pockets for retaining the cards therein.

2. The bingo game card holder of claim 1 wherein said cover means comprises a sheet defining corner portions and said means for releasably retaining said cover comprises means for retaining said corner portions in association with said base.

3. The bingo game card holder of claim 1 wherein said cover is formed of resilient sheet material.

4. A bingo game card holder comprising:

means defining a base having a plurality of upwardly opening pockets adapted to receive one each a plurality of bingo game cards in laterally related disposition for viewing of the plurality of cards by a player;

light-transmissive cover means for covering the bingo game cards received in said pockets while permitting reading of the cards therethrough, said cover means defining an upper writing surface constructed to be marked by conventional erasable marking means to identify called numbers appearing on the cards in said pockets;

means at opposite portions of said cover means for releasably retaining said cover means on said base in overlying relationship to said pockets for retaining the cards therein, said cover means comprising a sheet defining corner portions and said means for releasably retaining said cover means comprising means for retaining said corner portions is association with said base; and shoulder means upstanding from the base intermediate said means for retaining said cover portions for engagement therewith by the edges of the sheet to prevent lateral displacement of the sheet.

5. The bingo game card holder of claim 4 wherein said shoulder means defines a gap substantially midway between the means for retaining said corner portions.

6. The bingo game card holder of claim 4 wherein said means for retaining said corner portions in association with said base comprises openings in said base slidably receiving said sheet corner portions.

7. A bingo game card holder comprising:

a base sheet defining a plurality of upwardly opening, laterally related shallow pockets each adapted to receive one each a bingo card for viewing of the card by a player, said pockets having a depth corresponding to the thickness of the cards to be received therein;

a light-transmissive cover sheet for covering the bingo game cards received in said pockets to retain the cards therein while permitting reading of the cards therethrough, said cover sheet defining an upper writing surface constructed to be marked by conventional erasable marking means to identify called numbers appearing on the cards retained in said pockets by said cover sheet;

means upstanding from the base sheet for releasably retaining said cover sheet in overlying relationship to said base sheet and cards retained in said pockets thereof, said cover sheet defining a peripheral edge spaced inwardly of the peripheral edge of the base sheet when retained thereon by said retaining means; and means defining an access space adjacent an edge portion of the cover sheet for manipulation thereof in installing and removing the cover sheet relative to the base sheet.

8. The bingo game card holder of claim 7 wherein said base sheet defines an integral carrying handle.

9. The bingo game card holder of claim 7 wherein said base sheet defines an upstanding wall extending about the periphery of the cover sheet when the cover sheet is retained in overlying relationship to the base sheet.

10. The bingo game card holder of claim 7 wherein said sheets are formed of synthetic resin.

11. The bingo game card holder of claim 7 wherein said sheets are formed of synthetic resin and said pockets are integrally formed in said base sheet.

12. The bingo game card holder of claim 7 wherein said sheets are formed of synthetic resin and said means for releasably retaining said cover is formed integrally with said base sheet.

* * * * *